US010465870B2

(12) United States Patent
Stathes et al.

(10) Patent No.: US 10,465,870 B2
(45) Date of Patent: Nov. 5, 2019

(54) OPTICAL SHIELD FOR NARROW BEAM DISTRIBUTION IN LED FIXTURES

(71) Applicant: Hubbell Incorporated, Shelton, CT (US)

(72) Inventors: Nancy R. Stathes, Hillsdale, NJ (US); Federico Collado, Jr., Westwood, NJ (US); Ramesh Raghavan, Edison, NJ (US)

(73) Assignee: Hubbell Incorporated, Shelton, CT (US)

( * ) Notice: Subject to any disclaimer, the term of this patent is extended or adjusted under 35 U.S.C. 154(b) by 632 days.

(21) Appl. No.: 14/672,878

(22) Filed: Mar. 30, 2015

(65) Prior Publication Data

US 2015/0276184 A1 Oct. 1, 2015

Related U.S. Application Data

(60) Provisional application No. 61/971,834, filed on Mar. 28, 2014.

(51) Int. Cl.

| | |
|---|---|
| ***F21S 8/02*** | (2006.01) |
| ***F21V 13/10*** | (2006.01) |
| *F21V 7/00* | (2006.01) |
| *F21V 29/75* | (2015.01) |
| *F21V 29/77* | (2015.01) |
| *F21Y 115/10* | (2016.01) |

(52) U.S. Cl.

CPC ..... *F21S 8/024* (2013.01); *F21S 8/026* (2013.01); *F21V 13/10* (2013.01); *F21V 7/0033* (2013.01); *F21V 7/0066* (2013.01); *F21V 29/75* (2015.01); *F21V 29/77* (2015.01); *F21Y 2115/10* (2016.08)

(58) Field of Classification Search

CPC ..... F21S 8/024; F21S 8/026; F21V 13/10; F21V 29/77; F21V 7/0033; F21V 29/75; F21V 7/0066; F21V 7/0008; F21V 7/0058

USPC ..... 362/296.01, 364–366, 368, 370–372

See application file for complete search history.

(56) References Cited

U.S. PATENT DOCUMENTS

| | | | | |
|---|---|---|---|---|
| 3,833,955 | A * | 9/1974 | Hulbert, Jr. | F21S 8/00 362/253 |
| 6,572,234 | B1 * | 6/2003 | Maier | F21V 7/09 362/20 |
| 7,264,376 | B2 | 9/2007 | Burton | |
| 7,876,032 | B2 | 1/2011 | Arndt et al. | |
| 8,858,045 | B2 * | 10/2014 | Harbers | F21V 29/00 362/249.02 |
| 2003/0141420 | A1 | 7/2003 | Knight | |

(Continued)

FOREIGN PATENT DOCUMENTS

| | | | | |
|---|---|---|---|---|
| EP | 2230439 | A2 * | 9/2010 | H01L 31/052 |
| EP | 2466198 | | 6/2012 | |

OTHER PUBLICATIONS

PCT/US2015/23313 International Search Report and Written Opinion dated Jul. 2, 2015.

*Primary Examiner* — Diane I Lee
*Assistant Examiner* — Keith G. Delahoussaye
(74) *Attorney, Agent, or Firm* — Michael Best & Friedrich, LLP

(57) ABSTRACT

A light fixture assembly includes a light source, a reflector and a shield. The light source emits a beam of light. The reflector directs at least a portion of the beam of light emitted from the light source. The shield is positioned in the reflector to intercept at least a portion of the light emitted from the light source.

16 Claims, 10 Drawing Sheets

(56) References Cited

U.S. PATENT DOCUMENTS

| | | | | |
|---|---|---|---|---|
| 2005/0005490 | A1 | 1/2005 | Sender et al. | |
| 2006/0171151 | A1 | 8/2006 | Park et al. | |
| 2007/0147052 | A1 | 6/2007 | Wyatt | |
| 2009/0039799 | A1* | 2/2009 | Newman, Jr. | F21S 8/02 315/291 |
| 2010/0110698 | A1* | 5/2010 | Harwood | F21V 21/30 362/365 |
| 2011/0019409 | A1* | 1/2011 | Wronski | F21V 7/00 362/235 |
| 2012/0212945 | A1 | 8/2012 | Frank | |
| 2012/0294024 | A1 | 11/2012 | Peck et al. | |
| 2013/0215623 | A1* | 8/2013 | Goodman | F21V 21/00 362/341 |
| 2013/0343062 | A1 | 12/2013 | Shum et al. | |
| 2014/0063812 | A1 | 3/2014 | Geralds et al. | |

* cited by examiner

Footcandle Values at Nadir

| Distance | 10' | | | | | 15' | | | | | 20' | | | | | 25' | | | | |
|---|---|---|---|---|---|---|---|---|---|---|---|---|---|---|---|---|---|---|---|---|
| | Nadir | 5' | | 10' | | Nadir | 5' | | 10' | | Nadir | 5' | | 10' | | Nadir | 5' | | 10' | |
| Lamps | FC | FC | Diam | FC | Diam | FC | FC | Diam | FC | Diam | FC | FC | Diam | FC | Diam | FC | FC | Diam | FC | Diam |
| F4946 1100 lm 3000K | 179 | 75 | 2' | 5 | 4' | 79 | 33 | 3' | 2 | 6' | 46 | 19 | 3' | 1 | 7' | 29 | 12 | 4' | 1 | 8' |

OPTICAL SHIELD FOR NARROW BEAM DISTRIBUTION IN LED FIXTURES

CLAIM TO PRIORITY

This application is based on U.S. Provisional application Ser. No. 61/971,834, filed Mar. 28, 2014, the disclosure of which is incorporated herein by reference in its entirety and to which priority is claimed

FIELD

The disclosure relates to lighting devices and to recessed lighting fixture assemblies.

BACKGROUND

Light fixture assemblies, or luminaires, are used with electric light sources to provide aesthetic and functional housing in both interior and exterior lights. One type of light fixture assembly is a recessed light, typically used for interior lighting to conceal the light fixture in a wall or ceiling. In recessed lighting the light fixture is typically connected to a housing located in a cavity in the wall or ceiling. In recent years, lighting applications have trended towards the use of light emitting diodes (LEDs) as the light source in place of conventional incandescent lamps.

SUMMARY

According to an exemplary embodiment, a light fixture assembly includes a light source, a reflector and a shield. The light source emits a beam of light. The reflector directs at least a portion of the beam of light emitted from the light source. The shield is positioned in the reflector to intercept at least a portion of the light emitted from the light source.

According to another exemplary embodiment, a light fixture assembly includes a light source, a reflector and a shield. The light source for emits light through the reflector. A first portion of the light emitted from the light source strikes the reflector and a second portion of the light emitted from the light source would pass through the reflector without striking it. The shield is positioned in the reflector to intercept at least some of the second portion of light emitted from the light source.

According to another exemplary embodiment, a light fixture assembly includes a heat sink, a light source, a mounting bracket, a reflector and a shield. The light source is connected to the heat sink. The mounting bracket is connected to the heat sink. The reflector is connected to the mounting bracket and positioned to receive and redirect light from the light source. The reflector has a first open end proximate to the light source and a second open end distal from the light source. The shield is positioned between the first open end and the second open end of the reflector to block at least a portion of the light emitted from the light source.

Another exemplary embodiment includes a recessed lighting unit having a housing, a light source, a reflector and a shield. The light source is positioned in the housing for emitting a beam of light. The reflector directs at least a portion of the beam of light. The shield is positioned in the reflector to intercept at least a portion of the light emitted from the light source.

A further exemplary embodiment is includes a method of directing a narrow beam of light. Light is emitted from a light source into a reflector. The light is emitted at a first angle that would strike the reflector and a second angle that would pass through without striking the reflector. Light emitted from the light source at the second angle that would not strike the reflector is intercepted to narrow the overall beam of light emitted from the reflector.

BRIEF DESCRIPTION OF THE DRAWINGS

The above aspects and features of the present application will be more apparent from the description for the exemplary embodiments taken with reference to the accompanying drawings, in which.

DETAILED DESCRIPTION OF EXEMPLARY EMBODIMENTS

Figure 1:
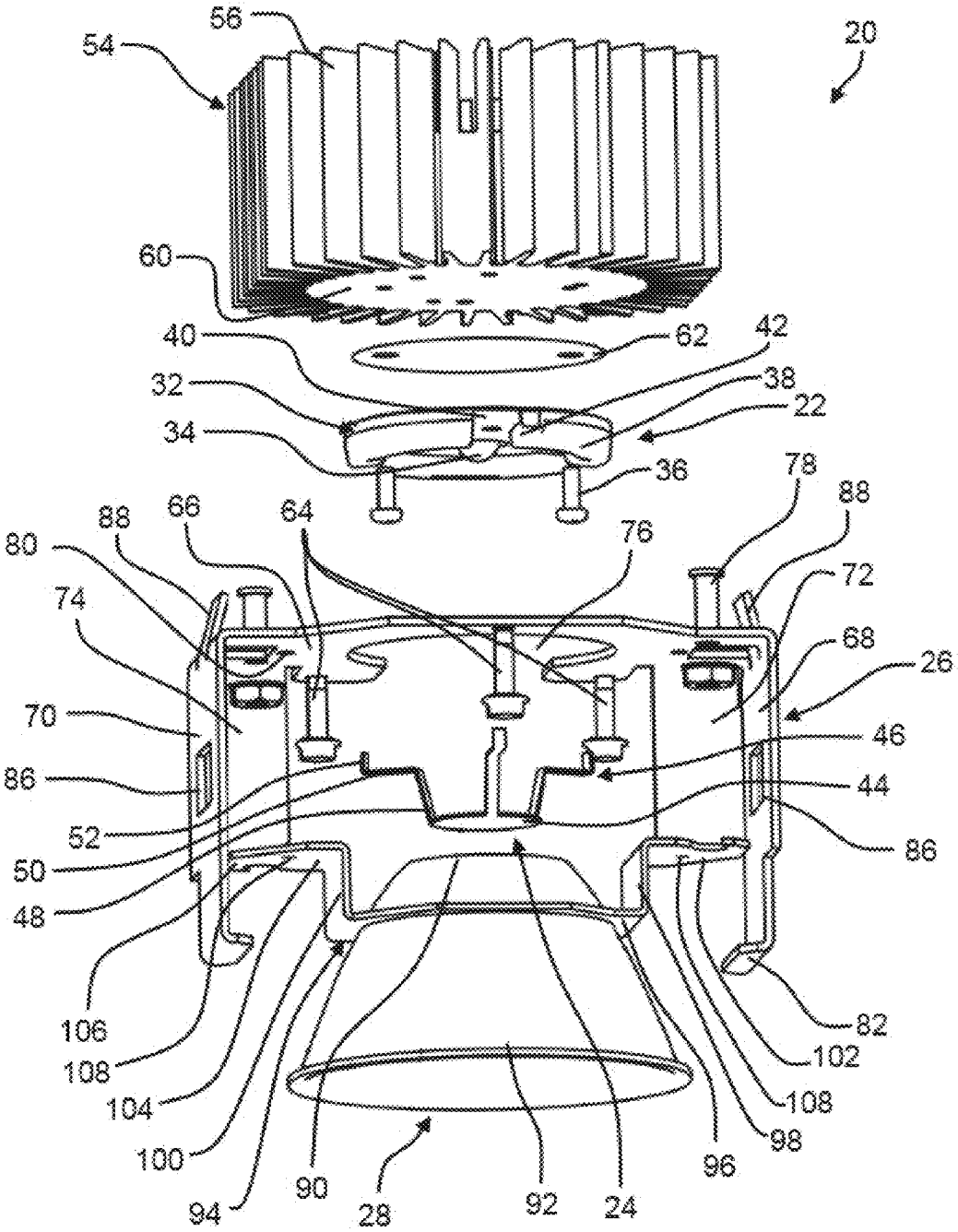
FIG. 1 is an perspective, exploded view of an exemplary light fixture assembly.

With light sources, including LEDs, it can be difficult to focus and direct emitted light to a desired area. To help overcome this problem, a light fixture assembly 20 is provided that enables a light source 22 to direct light with a narrow beam. In an exemplary embodiment, the light fixture assembly 20 includes a light source 22, an optical shield 24, a mounting bracket 26, and a reflector 28. The light fixture assembly 20 is shown and described in connection with an LED light source for use with a recessed light housing 30, although various exemplary embodiments may utilize, or be adapted to be used with, any type of light source and housing.

According to the exemplary embodiment of FIG. 1, the light source 22 includes an LED light module that is contained in a housing 32 and has a dome-shaped lens 34 surrounding one or more light generating elements. The housing 32 includes one or more apertures for optionally receiving mechanical fasteners 36 to mount the light source 22. The housing 32 also includes an outer rim 38 having one or more gaps 40. The gaps 40 are adjacent a tab 42 for connecting the light module by a twist-lock connection. An example of a suitable light source 22 is the PHILIPS®

FORTIMO® SLM LED modules, although various types of light sources 22 may be used with the exemplary embodiments described herein.

Figure 8:
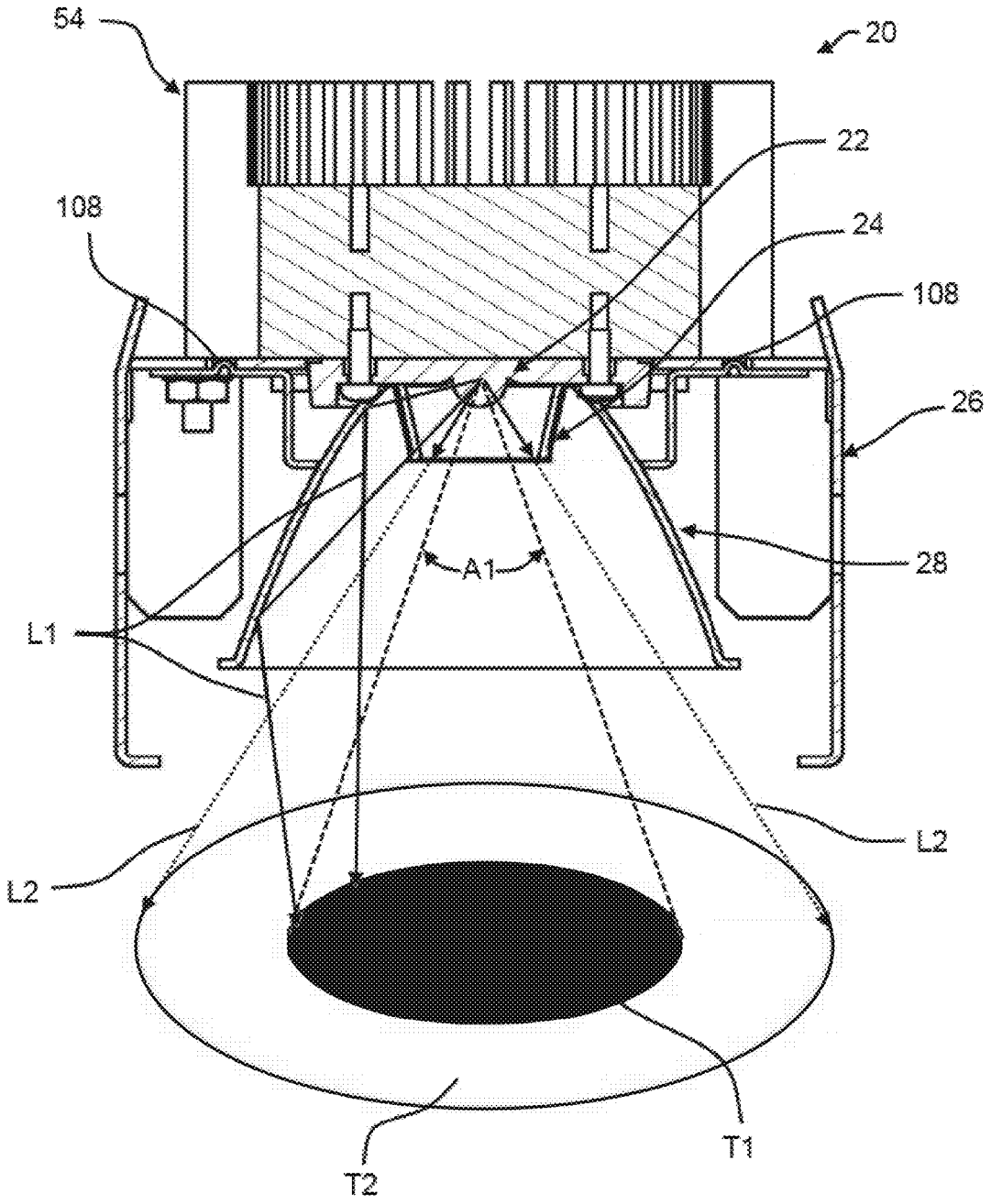
FIG. 8 is a front, sectional view of the light fixture assembly of FIG. 1 through a vertical plane.

FIGS. 1-4 most closely show an exemplary embodiment of an optical shield 24. The exemplary optical shield 24 has a central member, for example a disk 44, and one or more supports, for example three legs 46 extending outward from the disk 44 and upward toward the light source 22. The optical shield 24 intercepts at least a portion of the light that leaves the light source 22 as shown in FIG. 8 and described in greater detail below. Intercepting the light can mean to block, reflect, filter, direct, or performing any other optical function suitable to achieve a desired foil. For example, the optical shield 24 may be configured to allow some light to pass through depending on the desired light output. In various alternative embodiments, the disk 44 reflects and/or refocuses the light from the light source 22 using, for example reflectors or lenses, as opposed to blocking the light.

The size, shape, and configuration of the optical shield 24 can be varied depending on the size and shape of the light source 22, the size and shape of the reflector 28, and the desired light output. Even though a disk 44 is depicted and described herein, various alternative embodiments of optical shields 24 can be utilized and can have a central member in various sizes and shapes. For example an annular-shaped disk 44 can be used. The size, shape, length, and configuration of the supports can also vary, for example, fewer or more than three legs 46 may be used, the length of the supports can be varied, and the type of supports, including different types of mechanical fasteners, can be used.

Each leg 46 has a first portion 48 extending from the disk 44 towards the light source 22. The first portion 48 extends obliquely from the disk 44, for example at an obtuse angle as best shown in FIG. 1. A second portion 50 of the leg 46 extends radially and outwardly from the first portion 48 with respect to the disk 44. When assembled, the second portion 50 rests substantially against or close to a bottom surface of the light source housing 32. A third portion 52 of the leg 46 extends from the second portion 50 upward away from the disk 94. The third portion 52 of the leg 46 forms a tab that is designed to connect to the light source 22, for example, at the gaps 40 in the outer rim 38. The legs 46 may be resilient so that they can be clipped or snap-fit to the light source 22. In an exemplary embodiment, the shield 24 is made from a unitary piece of metal that can be resiliently manipulated to connect the shield 24 to the light source 22. Other materials suitable for blocking light may also be used. The shield 24 may also be made from multiple pieces and have different connections to the light source 22. Connections to other components of the light fixture assembly 20, for example the mounting bracket 26 or the reflector 28, can also be made. The size of the shield 24 and the distance from the shield 24 to the light source 22 may be varied depending on the type of light source 22, the type of reflector 28, and the desired qualities of the light beam emitted from the light fixture assembly 20, including beam angle and light intensity.

In certain exemplary embodiments, the light source 22 is thermally coupled to a heat sink 54, for example using one or more mechanical fasteners 36. Two mechanical fasteners 36 are shown connecting the light source 22 to the heat sink 54, although the number of fasteners 36 may vary depending on the type of heat sink 54 and the type of light source 22. The light source 22 may also be connected to the heat sink 54 through other mechanical or chemical connections.

The heat sink 54 includes a plurality of fins 56, a top surface 58, and a bottom surface 60. The bottom surface 60 has a plurality of openings to receive mechanical fasteners. The heat sink 54 is made from a thermally conductive material, for example a metal such as aluminum or copper. Various sizes, designs, and materials may be used in forming the heat sink 54 depending on the application and requirements of the light source 22 as would be understood by one of ordinary skill in the art. In certain embodiments, the heat sink 54 is omitted.

In certain embodiments, a thermal interface 62 is positioned between the light source 22 and the heat sink 54. The thermal interface 62 eliminates air gaps between the surfaces of the light source 22 and the heat sink 54, increasing the transfer of heat from the light source 22 to the heat sink 54. The thermal interface 62 may be a variety of compounds or materials and may come in a variety of forms, including gels, pads, tapes, and phase-change materials. Some examples of suitable thermal interfaces 62 include the CHOMERICS® thermal interface materials sold by PARKER HANNIFIN®.

According to the exemplary embodiment shown, the mounting bracket 26 is connected to the heat sink 54 by a plurality of fasteners 64. The mounting bracket 26 is made from metal, or other suitable material having the weight and strength requirements to attach the light fixture assembly 20 to the housing 30. Although shown as a unitary structure, various exemplary embodiments utilize multiple pieces connected together to form the mounting bracket 26.

In an exemplary embodiment, the structure of the mounting bracket 26 includes a base 66, a first side 68, a second side 70, a first back wall 72 and a second back wall 74. The base 66 includes a central aperture 76 for receiving the light source 22. Accordingly, the size and shape of the central aperture 76 may vary depending on the light source 22. The base 66 includes a first set of openings to receive the mechanical fasteners 64 connecting the mounting bracket 26 to the heat sink 54 and a second set of openings to receive mechanical fasteners 78 connecting the reflector 28 to the mounting bracket 26. The base 66 also includes a pair of depressions 80 that assist in aligning the reflector 28 with the mounting bracket 26.

Figure 10:
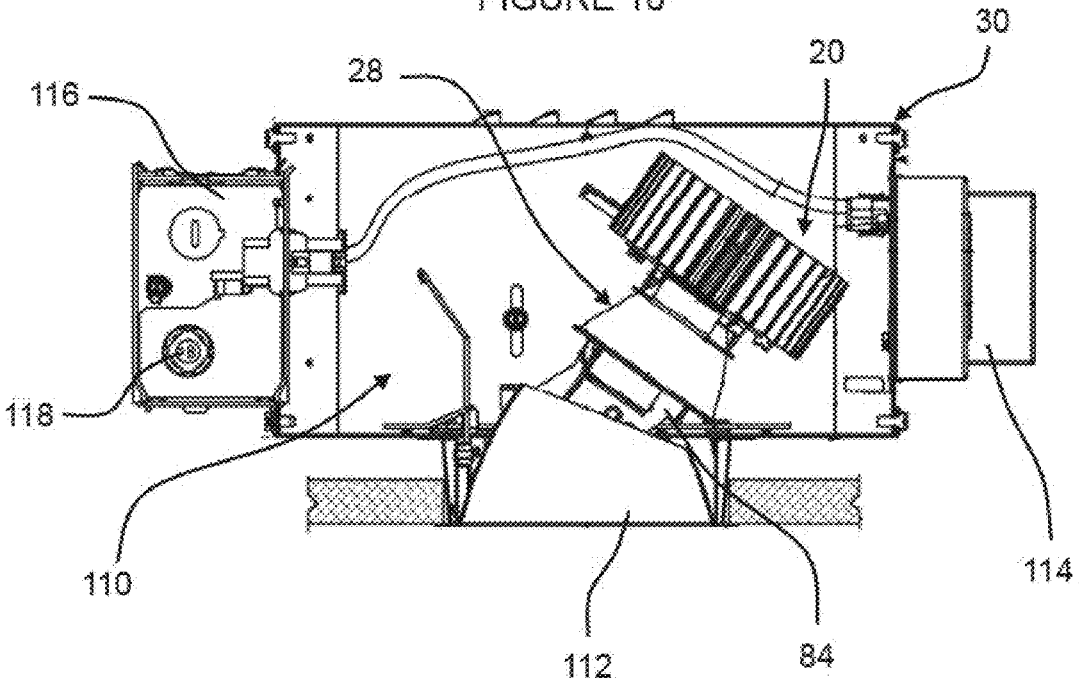
FIG. 10 is a side, sectional view of the recessed light housing of FIG. 9 containing the light fixture assembly of FIG. 1.

The first and second sides 68, 70 of the mounting bracket 26 extend from the base 66 away from the light source 22 at a substantially right angle, although the first and second sides 68, 70 may be angled obliquely depending on the required mounting connection. The first and second sides 68, 70 have a bottom projection 82 that extends inwardly towards the light source 22. The bottom projection 82 is used to slidably connect the mounting bracket 26 to a yoke member 84 in the recessed housing 30 as best shown in FIG. 10. The first and second sides 68, 70 also include a side opening 86 and a tab 88 that extends above the base 66. The side opening 86 is shown as a square aperture, although various sizes and shapes may be used depending on the housing connection. A resilient, angled tab from a yoke member 84 clips or snap-fits into the side opening 86. The tab 88 is similarly resilient and can clip or snap-fit into an aperture or recess.

Figure 2:
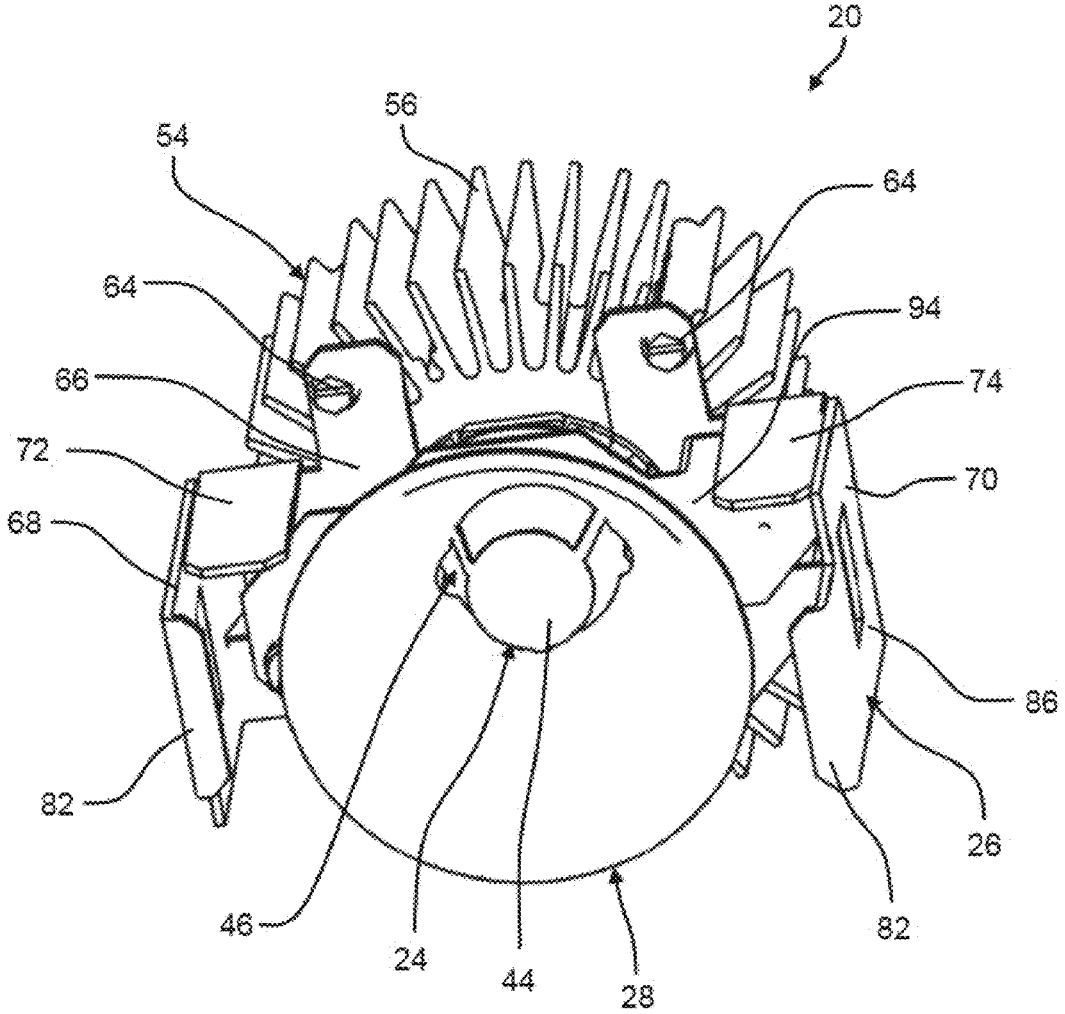
FIG. 2 is a bottom perspective view of the light fixture assembly of FIG. 1.
Figure 3:
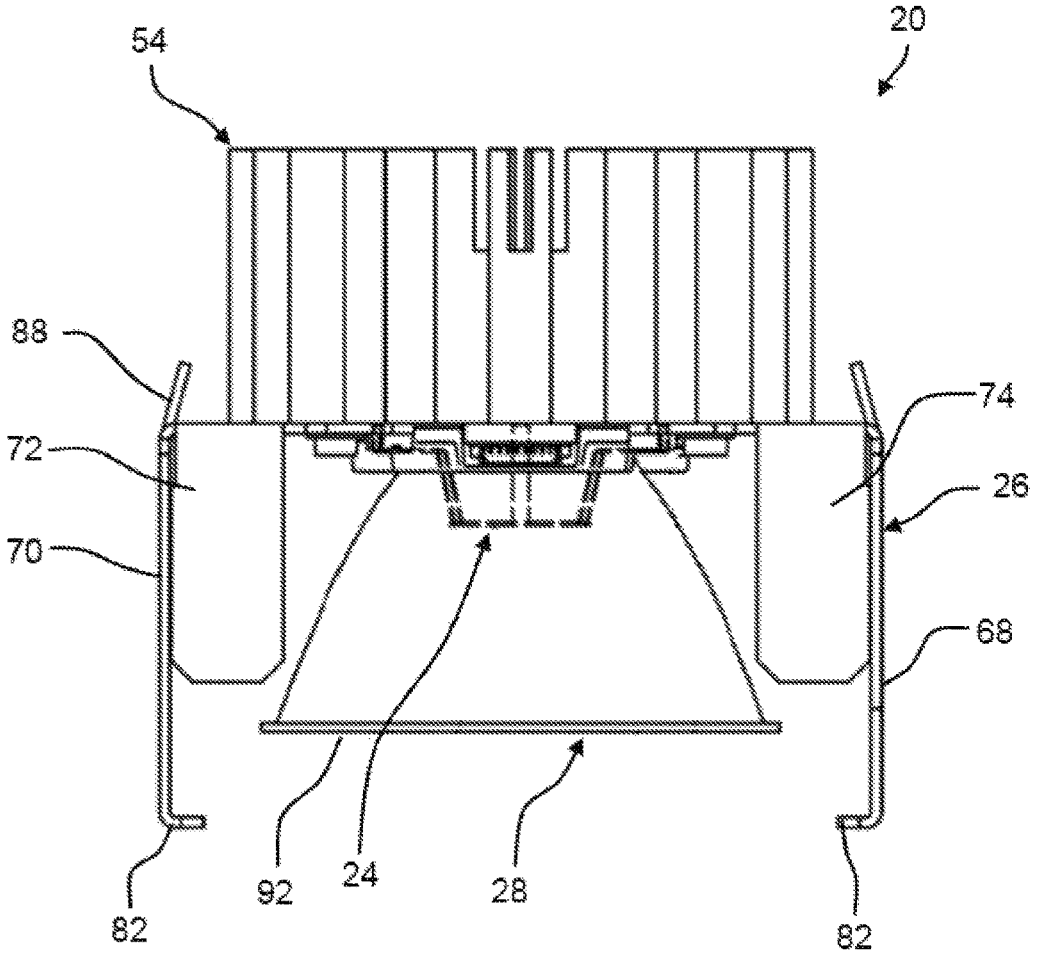
FIG. 3 is a front elevational view of the light fixture assembly of FIG. 1 with the shield and light source shown in dotted lines.
Figure 4:
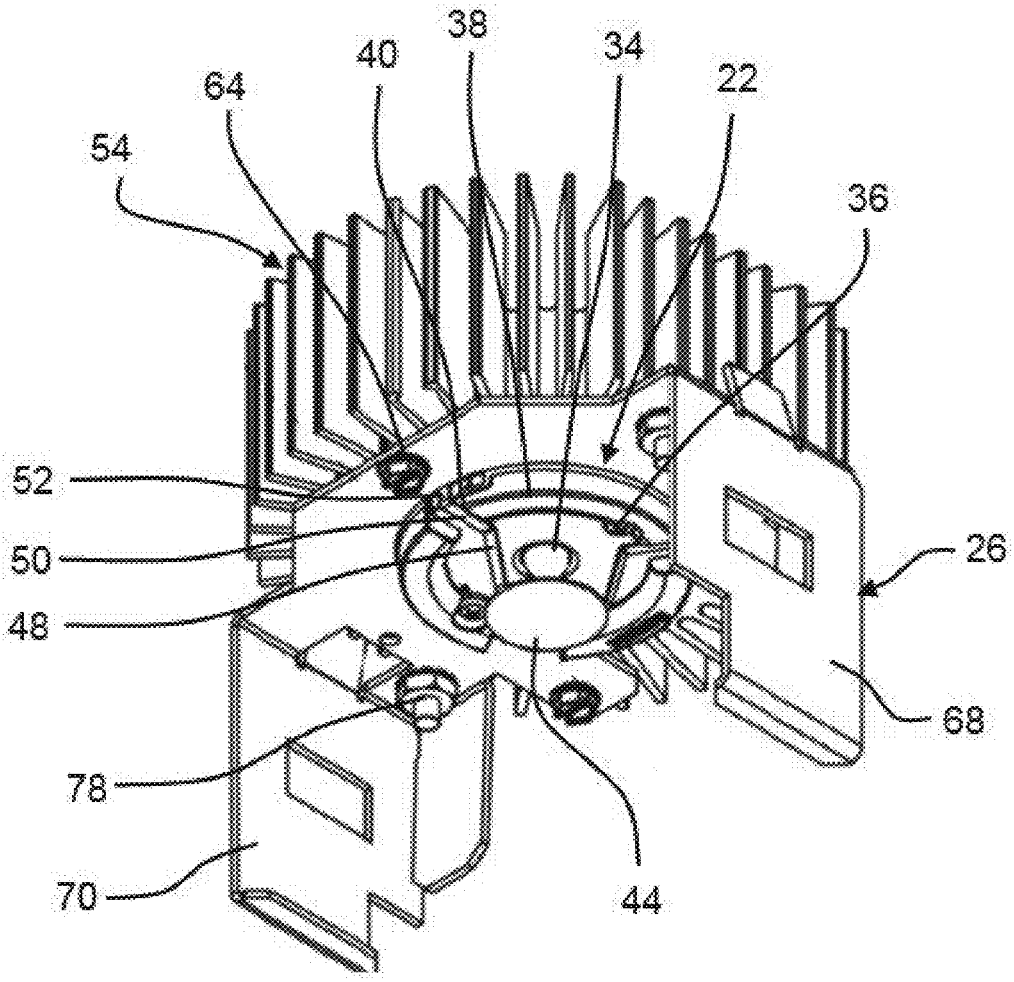
FIG. 4 is a bottom perspective view of the light fixture assembly of FIG. 1 with the reflector removed.
Figure 5:
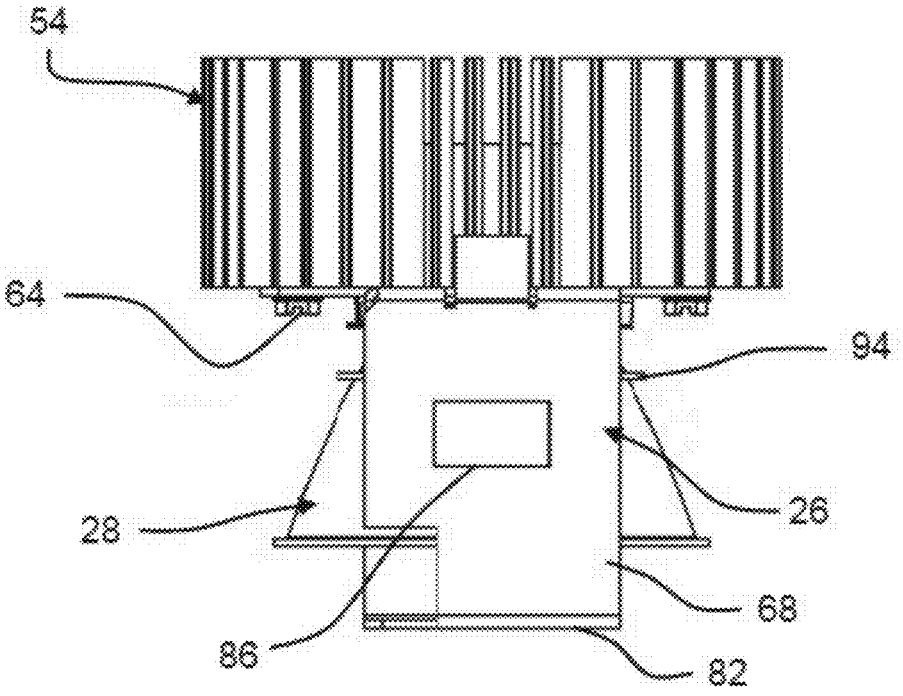
FIG. 5 is a right-side elevational view of the light fixture assembly of FIG. 1.
Figure 6:
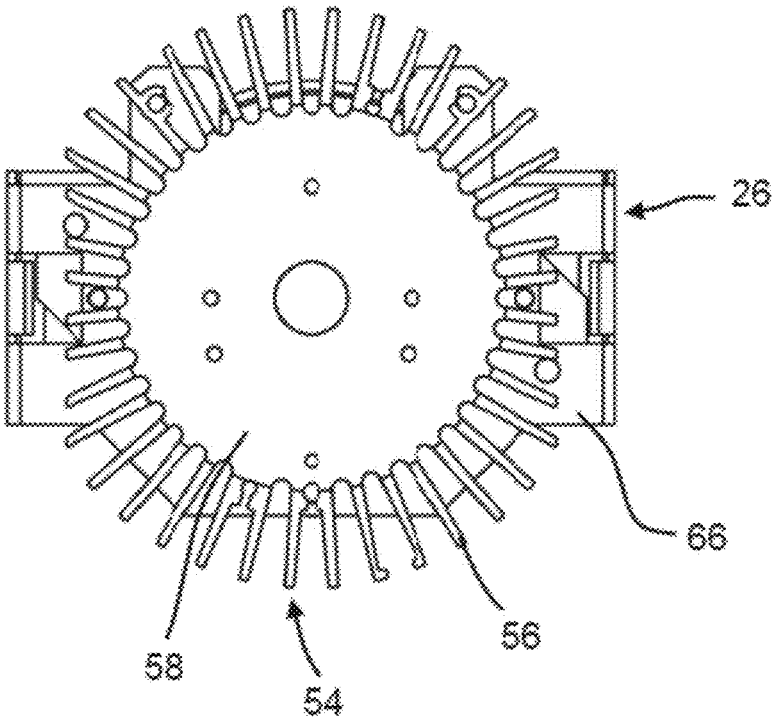
FIG. 6 is a top elevational view of the light fixture assembly of FIG. 1.
Figure 7:
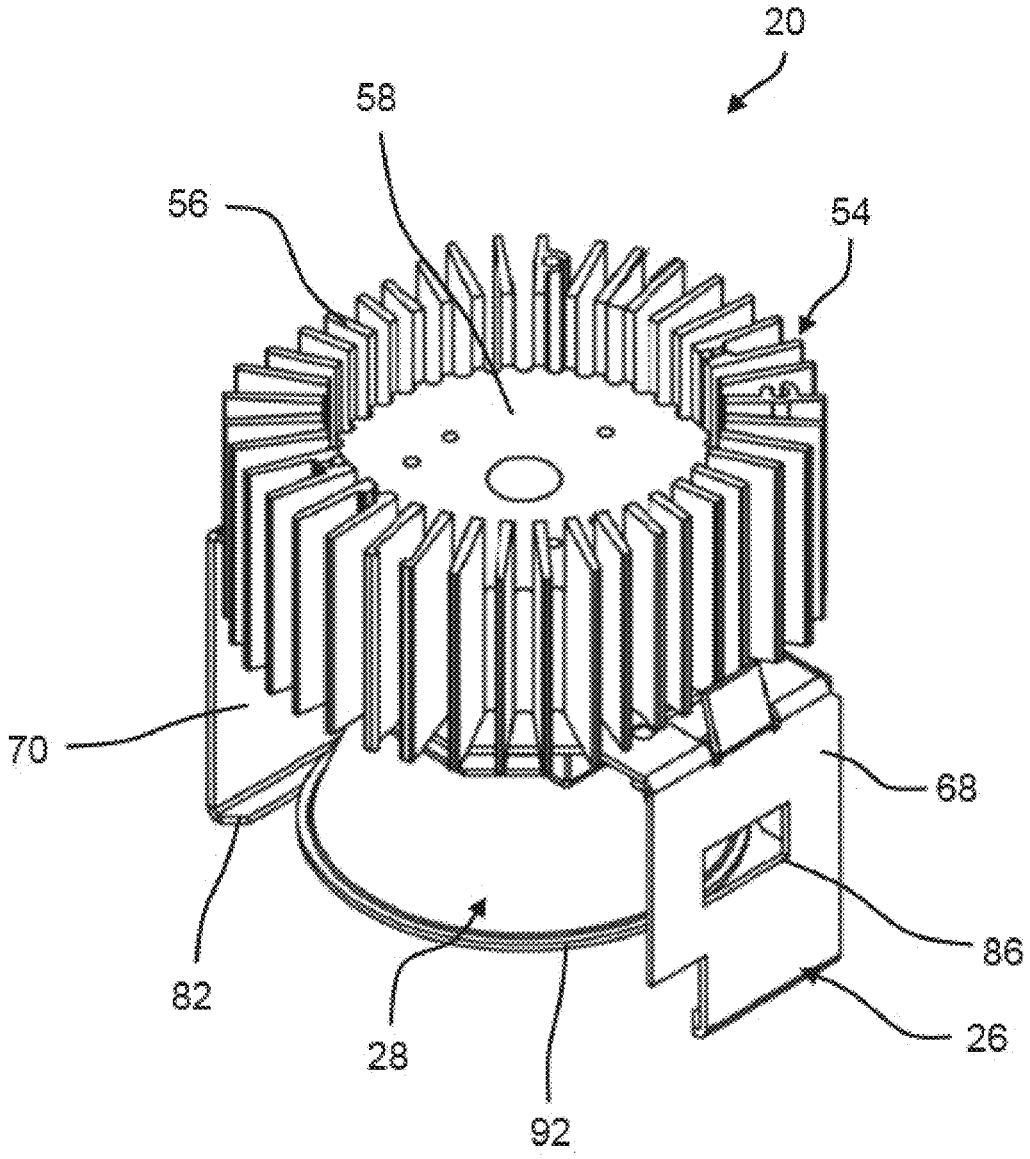
FIG. 7 is a top perspective view of the light fixture assembly of FIG. 1.

The reflector 28 is positioned to receive light emitted from the light source 22. As best shown in FIGS. 2 and 3, the reflector 28 has a frusto-conical shape with a first end 90 positioned proximate to the light source 22 and a second end 92 positioned distal from the light source 22. The reflector 28 is positioned at least partially around the lens 34. The shield 24 extends into the reflector 28. The type, size and shape of the reflector 28 can vary depending on the light source 22, the light fixture assembly 20, the housing 30, and the required light output. In an exemplary embodiment, the reflector 28 is a narrow beam reflector used for a recessed light housing. The distance from the light source 22 and the shield 24 to the first or second end 90, 92 of the reflector 28 may also be varied. In alternative exemplary embodiments, the reflector 28 and the shield 24 are unitarily formed.

The reflector 28 is connected to the mounting bracket 26 by a reflector bracket 94. The reflector bracket 94 has a bottom 96 with an opening for receiving the reflector 28. The reflector 28 may be held in place by a channel (not shown) formed in the reflector 28 that mates with the reflector bracket 94, by an interference fit, by an adhesive bond, by any combination thereof, or other suitable method. A first side 98 and a second side 100 extend from opposite ends of the bottom 96 at a substantially right angle. The length of the first and second sides 98, 100 may be varied to change the position of the reflector 28 with respect to the light source 22 or to properly position a reflector 28 of a different size. A first flange 102 extends from the first side 98 and a second flange 104 extends from a second side 100. Each flange 102, 104 has a hook 106 surrounding an opening. The opening receives a mechanical fastener 78, for example a bolt and k-lock nut. The first and second flanges 102, 104 also include an outwardly extending projection 108 that mates with the depression 80 of the mounting bracket 26 and assists in aligning the reflector bracket 94 with the mounting bracket 26.

FIG. 8 illustrates the use of the shield 24 in the light fixture assembly 20 according to one exemplary embodiment. As shown in FIG. 8, the shield is used to narrow the beam of light that is emitted from the reflector 28. A first portion of the light L1 emitted from the light source 22 strikes the reflector 28 and is directed to a target area T1. The shield 24 blocks a second portion of the emitted light L2. In an exemplary embodiment, the second portion of light L2 is emitted from the light source at an angle that would not strike the reflector 28, creating a wider beam angle, or pattern diameter, and distributing the light over a larger area T2. Blocking all of, or at least a portion of, the light that would not strike the reflector results in a narrower effective beam angle A1 and a smaller target area T1. In certain exemplary embodiments, the shield 24 is sized and positioned so that only light that has struck and been directed by the reflector 28 leaves the light fixture assembly 20. The shield 24 therefore narrows the beam and may also concentrate and intensify the projected light. Such concentrated light is useful in highlighting art, merchandise, accentuating architectural features, and creating a desired lighting ambiance.

Figures 12, 13:
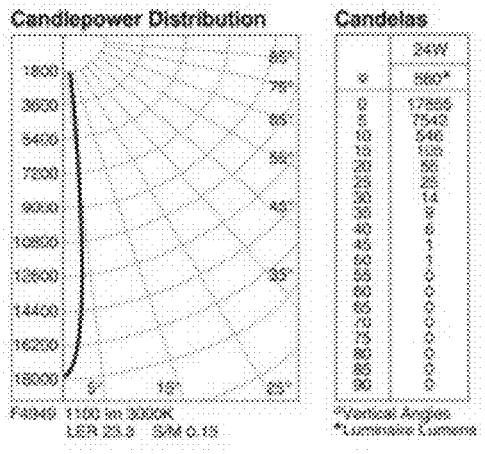
FIG. 12 is a table showing footcandle values at nadir of an exemplary light fixture assembly.
FIG. 13 are charts showing the candlepower disruption and candeals of an exemplary light fixture assembly.

In various exemplary embodiments the beam angle A1 of the emitted light is less than approximately 10 degrees. For example the beam angle A1 is approximately 7 degrees to approximately 10 degrees or approximately 8 degrees to approximately 10 degrees. In an exemplary embodiment the beam angle is approximately 8 degrees. FIGS. 12 and 13 show the candlepower distribution chart showing the intensity of the light fixture assembly 30 at different vertical and horizontal angles from the light source. In an exemplary embodiment, that light fixture produces an approximately 8 degrees beam spread without field, delivering over 17,000 candelas at nadir using only 24 W.

In certain exemplary embodiments, the optical shield 24 is configured based on a specific beam angle. Using the approximately 8 degree beam angle as an example, the reflector 28 and optical shield 24 can be configured to intercept light emitted from the light source 22 that would create a wider angle. The optical shield 24 could utilize a disk that would block light that would create a wider beam angle or redirect light so that it struck the reflector to ensure the appropriate beam angle. The optical shield 24 could also utilize a lens that redirected of focused light to ensure all light passing through the reflector stayed within the approximately 8 degree beam angle.

Figure 9:
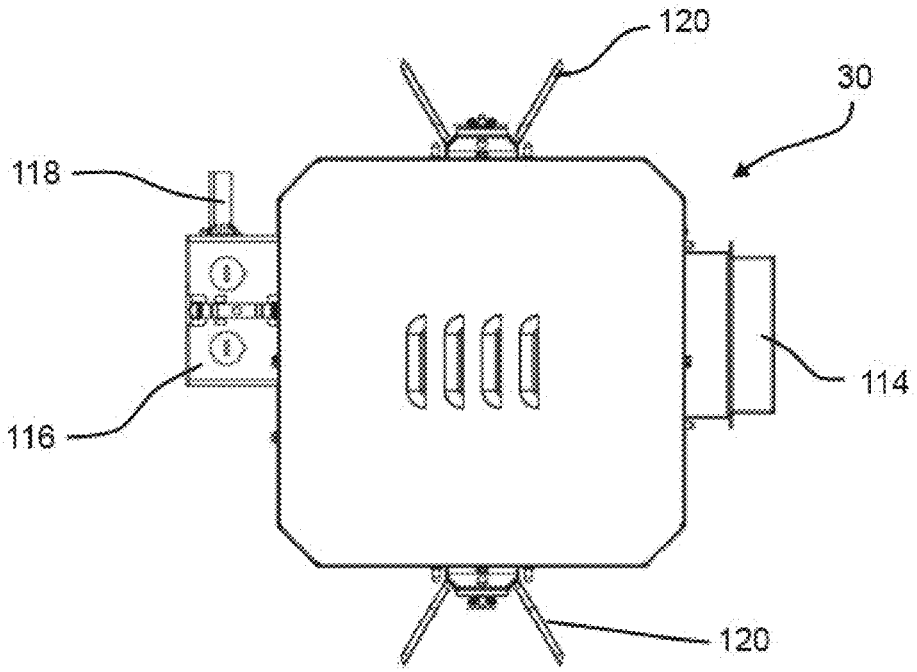
FIG. 9 is a top elevational view of a recessed light housing.
Figure 11:
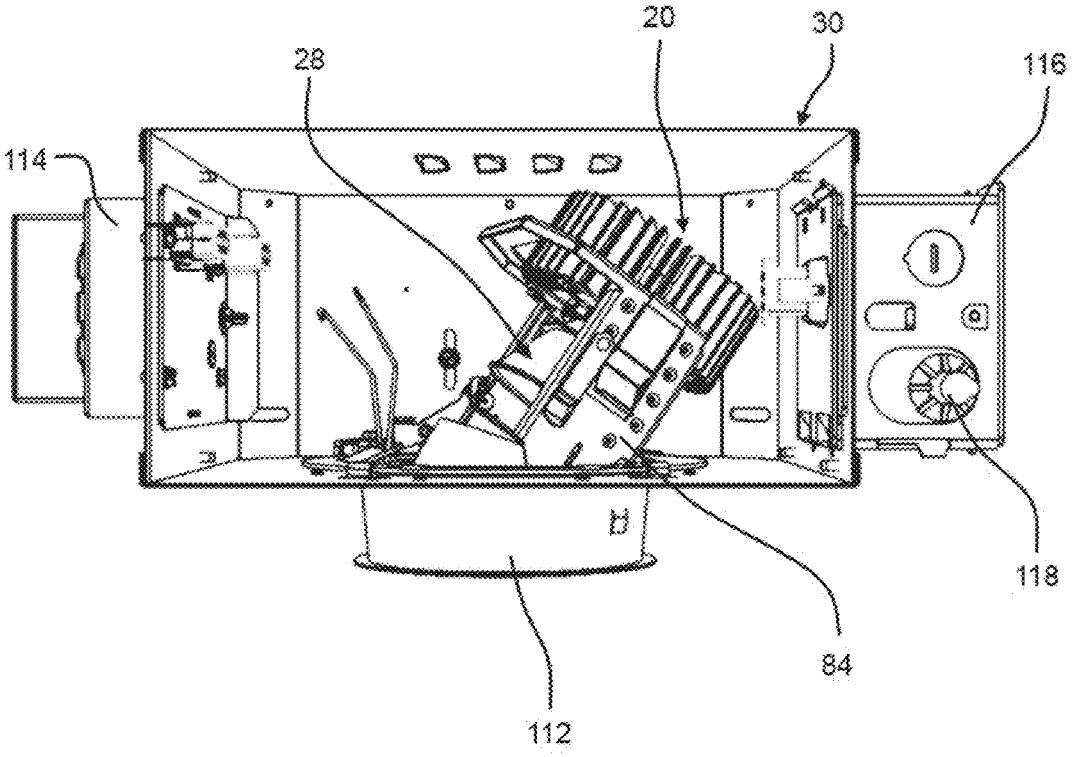
FIG. 11 is a perspective, sectional view of the recessed light housing of FIG. 9 containing the light fixture assembly of FIG. 1.

As best shown in FIGS. 9-11, the light fixture assembly 20 can be placed into a recessed light housing 30. The housing 30 includes a central chamber no enclosing the light fixture assembly 20. The mounting bracket 26 is connected to a yoke 84 to secure the light fixture assembly 20 in the central chamber 110. The yoke 84 allows the light fixture assembly 20 to rotate and be angled so that light is directed as desired by a user, although stationary yokes may also be used. The central chamber 110 has an opening surrounded by a cone 112 extending from one side. The light fixture assembly 20 is positioned so that light emitted from the reflector 28 is directed to pass through the cone 112. Light may pass uninhibited through the cone 112 or the cone 112 may further direct the emitted light. A secondary reflector also may be positioned in or near the cone 112 as needed to further direct the emitted light. A driver housing 114 houses an electronic driver that is electrically connected to the light source 22 to control the emitted light. The light source 22 and/or the driver may also be connected to a branch circuit junction box 116 having a thermal protector 118. The housing 30 includes first and second rail support brackets 120 to connect the housing 30 to a track or rail. In various alternative embodiments, the light fixture assembly 20 can be connected to other supports as would be understood by one of ordinary skill in the art.

The foregoing detailed description of the certain exemplary embodiments has been provided for the purpose of explaining the principles of the devices disclosed herein and their practical application. Those skilled in the art will understand from this disclosure the various embodiments of the devices and with various modifications as are suited to the particular use contemplated. This description is not necessarily intended to be exhaustive or to limit the embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A light fixture assembly comprising:

a mounting bracket;

a light source for emitting a beam of light;

a reflector connected to the mounting bracket and directing at least a portion of the beam of light;

a shield positioned in the reflector, wherein the beam of light includes light emitted from the light source at a first angle that strikes the reflector without striking the shield and light emitted from the light source at a second angle that would not strike the reflector and the shield blocks all the light emitted at the second angle, and wherein the mounting bracket comprises a base having a central aperture, a first depression, and a second depression, a first side extending from the base having a first side opening therein and a first tab extending therefrom, a second side extending from the base having a second side opening therein and a second tab extending therefrom, a first back wall extending from the base and a second back wall extending from the base.

2. The light fixture of claim 1, wherein the shield includes a central member and a support.

3. The light fixture of claim 1, wherein a heat sink is thermally coupled to the light source and a thermal interface is positioned between the heat sink and the light source.

4. The light fixture of claim 1, wherein the mounting bracket slidably connects to a support.

5. The light fixture of claim 4, wherein the support is positioned in a housing and includes a yoke rotatable about a first axis.

6. The light fixture of claim 5, wherein a reflector bracket connects the reflector to the mounting bracket.

7. The light fixture of claim 6, wherein the mounting bracket includes a depression and the reflector bracket includes a projection mating with the depression.

8. The light fixture of claim 1, wherein the beam of light emitted from the reflector has a beam angle of less than approximately 10 degrees.

9. The light fixture of claim 1, wherein the beam of light emitted from the reflector has a beam angle of approximately 8 degrees.

10. A light fixture assembly comprising:

a mounting bracket;

a reflector connected to the mounting bracket;

a light source for emitting light through the reflector, wherein a first portion of the light emitted from the light source strikes the reflector and a second portion of the light emitted from the light source would pass through the reflector without striking the reflector; and a shield positioned in the reflector, wherein the shield intercepts all the light leaving the light source that would not strike the reflector and wherein at least some of the first portion of light strikes the reflector without being intercepted by the shield, and wherein the mounting bracket comprises a base having a central aperture, a first depression, and a second depression, a first side extending from the base having a first side opening therein and a first tab extending therefrom, a second side extending from the base having a second side opening therein and a second tab extending therefrom, a first back wall extending from the base and a second back wall extending from the base.

11. The light fixture of claim 10, wherein the shield includes a central member and a support and the central member includes a disk.

12. A light fixture assembly comprising:

a heat sink;

a light source connected to the heat sink;

a mounting bracket connected to the heat sink;

a reflector connected to the mounting bracket and positioned to receive and redirect light from the light source, the reflector having a first open end proximate to the light source and a second open end distal from the light source; and a shield positioned between the first open end and the second open end of the reflector to block at least a portion of the light emitted from the light source that would not strike the reflector, wherein the mounting bracket comprises a base having a central aperture, a first depression, and a second depression, a first side extending from the base having a first side opening therein and a first tab extending therefrom, a second side extending from the base having a second side opening therein and a second tab extending therefrom, a first back wall extending from the base and a second back wall extending from the base.

13. The light fixture assembly of claim 12, wherein the light source includes a housing at least partially enclosing an LED light emitting element, a lens extending from the housing, a rim extending around the periphery of the housing, and at least one gap in the rim.

14. The light fixture assembly of claim 13, wherein the shield comprises a central member and at least one leg extending from the central member and the at least one leg attaches the shield to the light source at the gap in the rim.

15. The light fixture assembly of claim 12, wherein the reflector is connected to the mounting bracket by a reflector bracket.

16. The light fixture assembly of claim 15, wherein the reflector bracket comprises:

a bottom having an opening receiving the reflector;

a first side and a second side extending from the bottom;

a first flange having a first hook and a first protrusion extending from the first side; and a second flange having a second hook and a second protrusion extending from the second side, wherein the first and second protrusions mate with the first and second depressions, respectively.

* * * * *